US009173492B1

(12) United States Patent
Fortin

(10) Patent No.: US 9,173,492 B1
(45) Date of Patent: Nov. 3, 2015

(54) SELF-RECLINING CHAIR

(71) Applicant: Jacques Fortin, Levis (CN)

(72) Inventor: Jacques Fortin, Levis (CN)

( * ) Notice: Subject to any disclaimer, the term of this patent is extended or adjusted under 35 U.S.C. 154(b) by 0 days.

(21) Appl. No.: 14/297,796

(22) Filed: Jun. 6, 2014

(51) Int. Cl.

| | |
|---|---|
| ***A47C 3/025*** | (2006.01) |
| ***A47C 7/14*** | (2006.01) |
| ***A47C 1/035*** | (2006.01) |
| ***A47C 1/032*** | (2006.01) |
| ***A47C 1/14*** | (2006.01) |

(52) U.S. Cl.
CPC ..... *A47C 1/03261* (2013.01); *A47C 1/035* (2013.01); *A47C 1/14* (2013.01)

(58) Field of Classification Search
USPC ..... 297/85 C, 85 L, 88, 285, 451.7, 451.12, 297/452.15, 447.3, 447.4, 448.1, 448.2
See application file for complete search history.

(56) References Cited

U.S. PATENT DOCUMENTS 1,988,788 A * 1/1935 Goodman ..... 297/285
2,324,318 A * 7/1943 Niedringhaus ..... 297/285
2,530,924 A * 11/1950 Turner ..... 297/452.15
3,669,496 A * 6/1972 Chisholm ..... 297/452.15 X
3,743,352 A * 7/1973 Kallander ..... 297/285
4,157,203 A * 6/1979 Ambasz ..... 297/285 X
4,380,352 A * 4/1983 Diffrient ..... 297/88 X
4,498,702 A * 2/1985 Raftery ..... 297/312
4,529,246 A * 7/1985 Leib ..... 297/285
4,529,247 A * 7/1985 Stumpf et al. ..... 297/285 X
4,533,177 A * 8/1985 Latone ..... 297/285 X
4,555,139 A * 11/1985 Leib ..... 297/285 X
4,557,521 A * 12/1985 Lange ..... 297/285
4,585,272 A * 4/1986 Ballarini ..... 297/285 X
4,609,225 A * 9/1986 Loucks ..... 297/452.15 X
4,618,185 A * 10/1986 Kaufman ..... 297/285
4,690,454 A * 9/1987 Mizelle ..... 297/85 C X
4,703,974 A * 11/1987 Brauning ..... 297/285
4,707,028 A * 11/1987 Gamberini ..... 297/285 X
4,744,603 A * 5/1988 Knoblock ..... 297/285 X
4,783,121 A * 11/1988 Luyk et al. ..... 297/300.2
4,784,435 A * 11/1988 Leib ..... 297/451.7
4,787,672 A * 11/1988 Werner ..... 297/451.7 X
4,790,595 A * 12/1988 Hensel et al. ..... 297/285
4,790,596 A * 12/1988 Shifferaw ..... 297/451.7 X
4,848,837 A * 7/1989 Volkle ..... 297/300.1
4,856,846 A * 8/1989 Lohmeyer ..... 297/285
4,889,385 A * 12/1989 Chadwick et al. ..... 297/285 X
4,892,356 A * 1/1990 Pittman et al. ..... 297/452.15
4,911,500 A * 3/1990 Saiger ..... 297/451.7 X
4,911,501 A * 3/1990 Decker et al. ..... 297/285 X
4,913,493 A * 4/1990 Heidmann ..... 297/285
5,039,164 A * 8/1991 Gibbs ..... 297/285 X
5,056,862 A * 10/1991 May et al. ..... 297/85 C
5,102,196 A * 4/1992 Kaneda et al. ..... 297/452.15
5,114,210 A * 5/1992 Naess ..... 297/285 X
5,123,702 A * 6/1992 Caruso ..... 297/440.21
5,292,170 A * 3/1994 LaPointe et al. ..... 297/85 C (Continued)

*Primary Examiner* — Rodney B White

(57) ABSTRACT

A lightweight self-reclining chair for outdoor having a skid-like to stand over any ground. The chair variable geometry frame comprising an articulated arched-shaped seat panel with an hinged back-rest panel and an hinged leg-rest panel clamped over upper ends of front-leg and rear-leg of a U-shaped chair support base; lower end of rear-leg U-shaped form chair support base being fitted with spring-hinge to pull back the seat in a reclined motion. The chair is equipped with hand-operable tension mechanism having integrated stopper to provide incremental adjustment on chair reclined a seat back angle with auto-pivoting of a leg-rest panel.

9 Claims, 6 Drawing Sheets

(56) References Cited

U.S. PATENT DOCUMENTS

| | | | | | |
|---|---|---|---|---|---|
| 5,314,240 | A * | 5/1994 | Ishi et al. | 297/452.15 | |
| 5,318,346 | A * | 6/1994 | Roossien et al. | 297/452.15 | X |
| 5,320,410 | A * | 6/1994 | Faiks et al. | 297/285 | X |
| 5,340,197 | A * | 8/1994 | Vogtherr | 297/285 | X |
| 5,360,255 | A * | 11/1994 | Cook et al. | 297/85 C | X |
| 5,368,366 | A * | 11/1994 | Mizelle | 297/85 L | X |
| 5,383,712 | A * | 1/1995 | Perry | 297/451.7 | X |
| 5,538,326 | A * | 7/1996 | Lorbiecki | 297/452.15 | |
| 5,697,673 | A * | 12/1997 | Favaretto | 297/285 | X |
| 5,704,688 | A * | 1/1998 | Schrewe et al. | 297/285 | |
| 5,716,099 | A * | 2/1998 | McDiarmid | 297/302.1 | |
| 5,823,626 | A * | 10/1998 | Haas | 297/448.2 | |
| 6,056,361 | A * | 5/2000 | Cvek | 297/448.2 | X |
| 6,070,937 | A * | 6/2000 | Ginat | 297/285 | |
| 6,257,665 | B1 * | 7/2001 | Nagamitsu et al. | 297/285 | |
| 6,409,262 | B1 * | 6/2002 | LaPointe | 297/85 C | X |
| 6,837,539 | B1 * | 1/2005 | Casey | 297/448.2 | X |
| 7,226,127 | B1 * | 6/2007 | Yevko et al. | 297/285 | X |
| 7,237,841 | B2 * | 7/2007 | Norman et al. | 297/301.3 | |
| 7,396,079 | B2 * | 7/2008 | Heidmann et al. | 297/285 | |
| 7,431,387 | B2 * | 10/2008 | LaPointe et al. | 297/85 L | X |
| 7,896,439 | B2 * | 3/2011 | Kan et al. | 297/285 | X |
| 7,992,936 | B2 * | 8/2011 | Schmitz et al. | 297/285 | X |
| 8,616,640 | B2 * | 12/2013 | van Hekken | 297/299 | X |
| 8,820,835 | B2 * | 9/2014 | Minino et al. | 297/285 | X |
| 9,055,817 | B2 * | 6/2015 | Weber et al. | 297/448.2 | X |
| 2004/0251729 | A1 * | 12/2004 | Olson | 297/448.2 | X |
| 2010/0301652 | A1 * | 12/2010 | Ballendat | 297/285 | X |
| 2012/0086251 | A1 * | 4/2012 | Parker et al. | 297/285 | |
| 2012/0153700 | A1 * | 6/2012 | Weber et al. | 297/445.1 | |
| 2012/0228911 | A1 * | 9/2012 | Piretti | 297/285 | |
| 2013/0001994 | A1 * | 1/2013 | Wu | 297/285 | |
| 2014/0265493 | A1 * | 9/2014 | Machael et al. | 297/285 | |

* cited by examiner

SELF-RECLINING CHAIR

BACKGROUND OF THE INVENTION

This invention relates to a reclining chair and more specifically to a light weight type of reclining chair made for outdoor use.

PRIOR ART

Most of existing outdoor reclining chairs require setting of a seat back angle before sitting. Some have a seat back reclining control fitted on an arm rest which is not always easy to engage. These chairs have adjustment for a reclining angle without an adjustable seat curvature. Furthermore, existing indoor reclining chairs have complex mechanism with several articulated components and are of relatively heavy fabrication, which is not well adapted for outdoor use when exposed to corrosion.

Such existing reclining chairs has been of a continuing need for improvement, and this new reclining chair concept of light weight design is fitted with a simple mechanism well adapted for outdoor use. Our new chair provides an easy control of reclining motion with improved seating comfort.

OBJECTIVES AND ADVANTAGES

The reclining chair is made of resilient flexible material and comprises an arch seat panel mounted on a support frame provided with a seat portion panel fitted with a living hinge connection to a back-rest panel, the seat furthermore comprises an easy tension mechanism producing the reclined positions of the chair. Cut-out openings on an arch curvature of the seat and on the curvatures of the support frame accentuate the flexibility.

The chair has a minimum of articulated components and provides a reclining motion by means of a light tension mechanism that allows incremental adjustments at a desired seat back angle, modification of the seat curvature and auto-lifting of a linked leg-rest panel. Easy adjustment of the reclining motion is controlled by the tension mechanism, and the chair geometry is regulated using a crank handle. This mechanism provides adjustment of the seat curvature to improve comfort and avoid need for a thick cushion.

The chair with a flexible resilient U-shaped support frame is shaped like a skid for easy pull over soft ground, like a sandy beach. When the chair is standing on hard ground, a full tension on the control mechanism induces a slight curve of the flat section of the skid for rocking of the chair if desired. With reference to the above description, this new concept of self-reclining chairs improves seat comfort. The light weight and compact geometry of the concept make this chair well adapted for outdoor and indoor use with easy adjustment of the seat back angle.

The particularity of the chair flexible geometry and the control mechanism make this invention very distinctive compared to existing listed reference patents on the subject.

LIST OF RELATED PATENTS

U.S. Pat. No. 7,185,948 <<Collapsible reclining chair>> filed on Jun. 27, 2005.

U.S. Pat. No. 4,662,852 <<Floating, reclining, lounge mechanism>> filed on Jan. 24, 1986

U.S. Ser. No. 14/059,275 <<Reclining chair>> filed on Oct. 21, 2013

U.S. Pat. No. 5,009,466 <<Reclining chair>> filed on Apr. 24, 1989

U.S. Pat. No. 5,782,535 <<Armchair>> filed on May 22, 1996

The present invention will be further understood from the following description with reference to the drawings wherein like numbers refer to like parts for easy identification.

BRIEF DESCRIPTION OF DRAWINGS FIGURES

DETAILED DESCRIPTION OF THE PREFERRED EMBODIMENT

In the following description and in the accompanying drawings, the numeral numbers refer to identical parts in the various Figures.

General Design Principle

This self-reclining chair concept is based on the resiliency of a flexible variable geometry frame that provides easy means of self-reclining motion with a limited number of mechanical linked components. The chair is made with a flexible arch seat articulated over a flexible arch support frame fitted with a tension mechanism that creates a spring load to pull the chair into a reclining motion, adjust the seat curvature and induce rotation of the hinged leg rest panel.

Chair Seat, Chair Support and Leg Rest Panel

Figure 1:
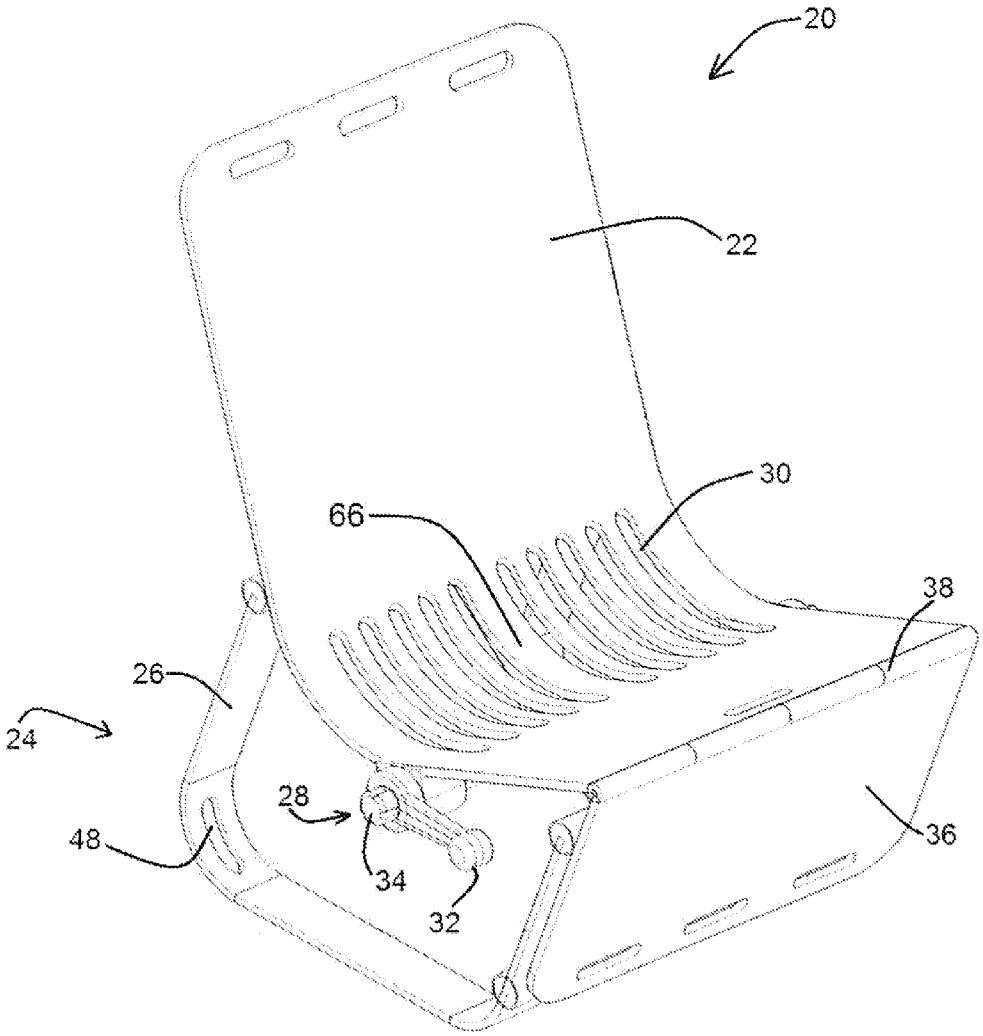
FIG. 1 is an isometric view of a chair, from above.
Figure 2:
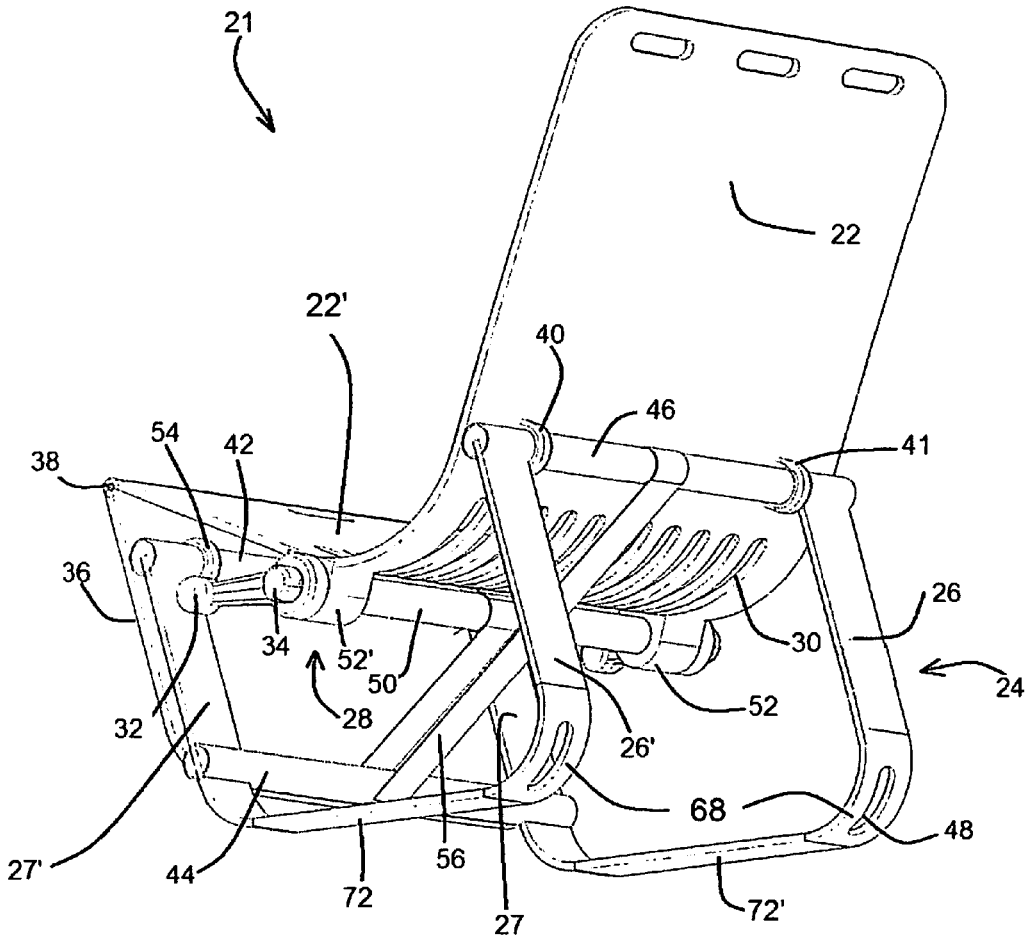
FIG. 2 is an isometric view of a chair, from under.

FIGS. 1 and 2 show the leg-rest panel 36 hinged 38 in extension of a flexible arched seat panel 21 having a seat portion panel 22' fitted with a living hinge 66 connection to a back-rest panel 22. The arched-shaped seat panel and the leg-rest panel are articulated over a rear transverse bar 46 and a front upper transverse bar 42 of a U-shaped support frame 24 by means of articulated clamps 40,41.

The arched-shaped seat panel has cut-out openings 30 along the seat to provide greater flexibility. The leg rest panel has hinges in extension of the arched-shaped seat panel and is free to rotate around an upper front transverse bar 42 and is stopped by a lower transverse bar 44 when the chair is pulled into a sitting position.

Chair U-Shaped Support Frame

The U-shaped support frame 24 is shaped like a skid over the ground and has an articulated aft end section bent upwards to provide a spring effect that is used to pull back the chair seat.

The U-shaped support frame further comprises a forward end and an aft end which define a pair of arch-shaped rear legs 26,26' turned upwardly to receive the arched-shaped seat panel 21. Front legs of the support are identified 27,27'. Ends or feet of the arch-shaped legs being joined by the transverse bars 42 and 46; the front upper transverse bar 42 supporting the arched-shaped seat panel 21 at knee level, and the rear transverse bar 46 is supporting the arched-shaped seat panel at back level. The horizontal members in contact with the ground are 72,72'. The rear bending radius section has cut-out openings 48 to reduce when necessary the section for adjustment of the spring load.

The U-shaped support frame forward section is shaped with an upward bend with a stronger structural section to resist the forward pushing reaction load in order to stay rigid during a reclining motion.

Tension Mechanism

FIG. 2 shows furthermore the tension mechanism that operates like a winch pulling on a tackle; this provides the required load reduction ratio on a crank handle 32 that is used to control the tension mechanism. The tension mechanism includes a winch shaft 50 fixed with pillow blocks 52,52' under the arched-shaped seat panel 21 and has a tension tackle strap 56 rolled around the winch shaft and passing around the front lower transverse bar 44 with the strap end pulling on the rear transverse bar 46 of the U-shaped support frame.

The winch shaft has crank handles on both sides of the chair to adjust the seat reclined position; thus permitting variations in the seat curvature and rotation of the leg rest panel.

Spring Parts Hinge Joints

In FIGS. 1-2 one see the panel comprises a spring part hinge joint 66 defining a hip base inflexion point destined to receive a haunch of a person, and the support comprises a spring part hinge joint 68 positioned behind the panel spring part hinge joint 66. When pulling said tension mechanism 28 thus bending both spring part hinge joints 66,68 and reclining both arched-shaped seat panel 21 and the U-shaped support frame 24.

Control Stopper

Figure 3:
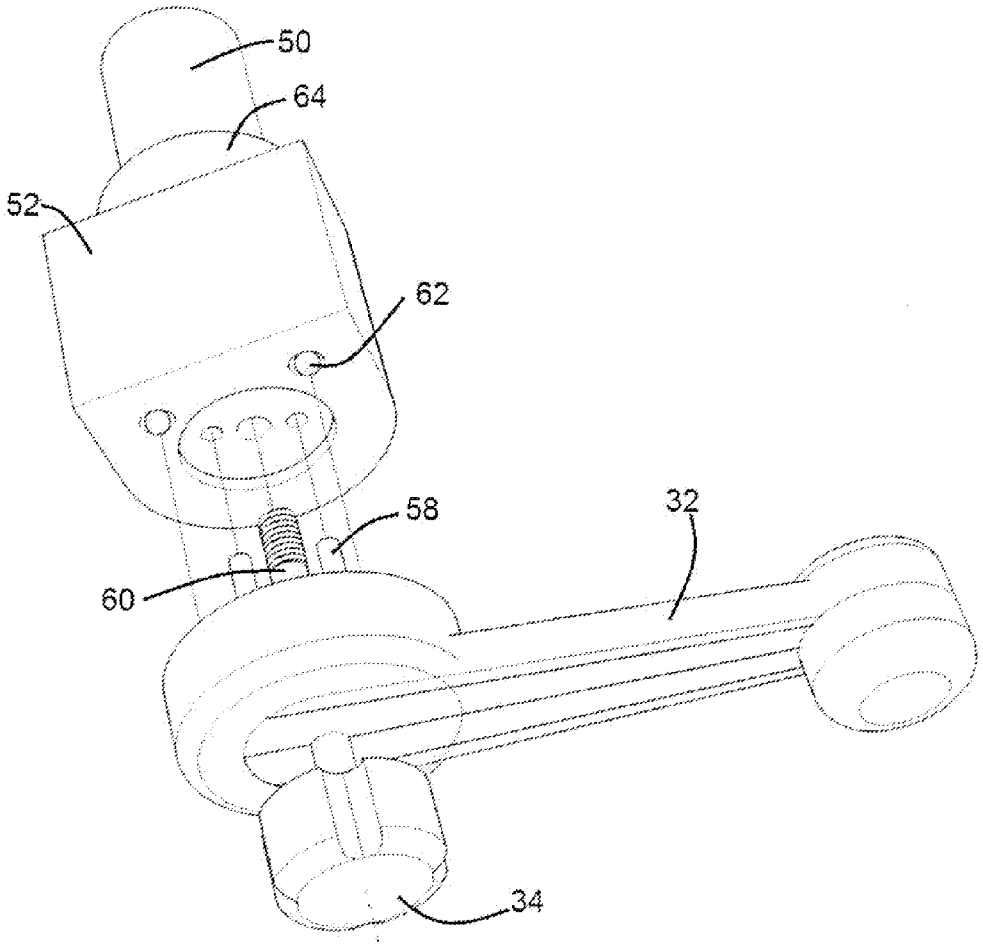
FIG. 3 is an isometric view of a control stopper.

FIG. 3 shows an arrangement of the control stoppers of the tension mechanism which is mounted at both ends of the winch shaft 50. Including a crank handle 32 fitted with a pressure control knob 34 for pre-setting of the stopper pressure engagement.

The stopper made between an interface of the winch shaft pillow block 52,52' outer face and the inner face crank handle 32 and a spring ball 62 are fitted on the pillow block outer face to engage drilled cavities of the crank handle inner face, this allowing an incremental stop of the crank motion.

The pressure control knob 34 is screwed at the end of a winch shaft center with a bolt 60 to adjust the pressure of stopper engagement by pressing the crank handle against the pillow block contact face.

The winch shaft 50 has a fixed ring stopper 64 bearing over the pillow block inner face to prevent shaft displacement when a pressure is applied against the outer face by the stopper.

The crank handle inner face has sliding pins 58 engaged in the shaft end to transfer a torque load to the shaft winch.

Positions of the New Reclining Chair:

Reclining Seat Position

In a reclining seat position of the chair, both arched-shaped seat panel and U-shaped support frame are held in a forced bent position by the tension mechanism that pulls down the seat and pulls on the rear transverse bar of the U-shaped support frame. The leg-rest panel is forced down by the resulting horizontal forward reaction load on the hinge of the leg rest panel which is then pushed to rotate downward to bear over a lower part of the chair support base.

Figure 4A:
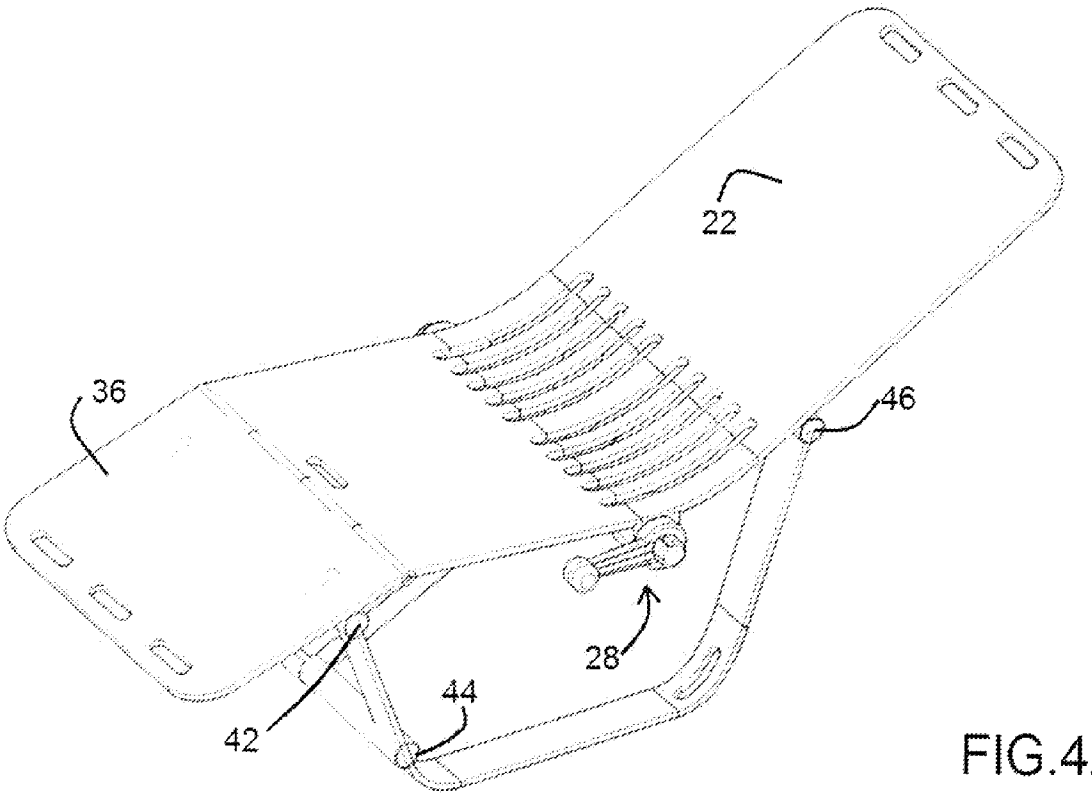
FIGS. 4A and 4B are isometric views of chair reclined positions.

FIG. 4A shows when tension is released by rotating the crack handle 32 on the pulling mechanism 28, the spring load from the bent U-shaped support frame pulls the arched-shaped seat panel to rotate backwards, this motion flattening the seat curvature and pulling on the leg-rest panel linked to the arched-shaped seat panel to rotate upwardly to a maximum horizontal position limited by the hinges 38 configuration. The reclining motion is held in the desired position by means of the stopper 34 fitted on the crank handle inner face. The previously settled stopper engagement balances the turning moment induced in the shaft by the tension mechanism allowing to hold the reclined position of the chair at the desired seat back angle.

Return to a Straight Seat Position

Figure 4B:
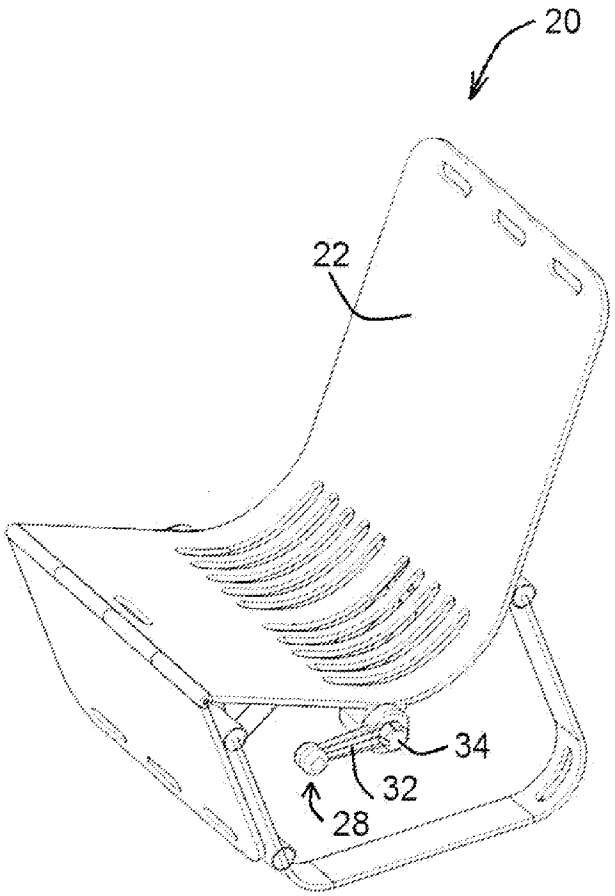

FIG. 4B shows the chair 20 pulled back to the straight position by increasing tension on the pulling mechanism 28 using the winch crank handle 32. At the end of the motion the seat curve panel 22 is pulled down and the optimum tension could be made by bending the skid supports for rocking of the chair if desired. The stopper pressure engagement should be adjusted if necessary by tightening the pressure control knob 34.

Simplified Model

Figure 5:
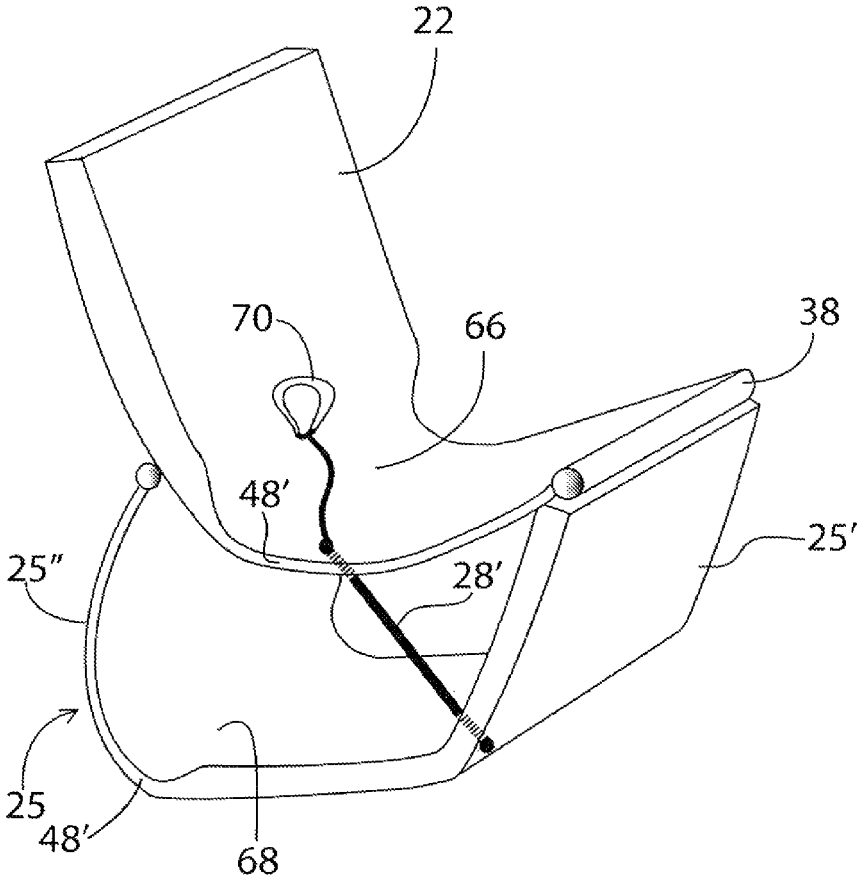
FIG. 5 is a perspective view of simplified model of the reclining chair.

FIG. 5 shows a simplified model of the reclining chair having an U-shaped support frame 25 comprises two ends upwardly directed: a rigid forward end 25' and a flexible aft end 25".

The arched-shaped seat panel 21 has a spring part hinge joint 66 defining a hip base inflexion point destined to receive a haunch of a person. The support comprises also a spring part hinge joint 68 positioned behind the panel spring part hinge joint 66 and forming an arch terminated by the aft end 25".

Both spring parts hinge joints 66,68 comprise a reduced geometrical section 48' of the material, thus rendering the material more flexible.

A simple tension mechanism 28' comprising a rope ending with means of grip 70 for being rigged to pull for tension adjustment and thus for bending both spring part hinge joints 66,68 and recline the arch seat and the support. When pulling the tension mechanism 28 thus bending both spring parts hinge joints 66,68 and reclining the whole chair 20; arch seat 22 and support 25.

SUMMARY

This new invention for a self-reclining chair provides highly reliable, light weight and comfortable seats fitted with a simple control device that can be used by persons of almost any age.

This chair has a skid like support configuration and could be easily moved over any ground including sandy beaches. This light weight chair concept could be fabricated with plastics and aluminum components well adapted for outdoor weather conditions.

While the above description contains many specificities this should not be considered as limitation on the scope of the invention that could be used in other possible embodiment.

For example the rest leg-panel could have been excluded by fitting the front articulation of the arched-shaped seat panel directly over the upper transverse bar of the U-shaped support frame; the principle used for the chair operation would still be applicable without this component. It is evident that the required flexibility of the arched-shaped seat panel could be achieved by many other ways than using the shown cut-out opening, for example, this could have been made using transversal grooves on the panel surface or by adding hinges to allow bending, this depending upon choice and mechanical properties of the material used for the arched-shaped seat panel component.

This new patent apparatus could be used to design an indoor adapted reclining seat with added arm rests and a head adjustable support with the advantage of using a very light weight and simple mechanism compared to existing ones. For indoor use the flexible U-shaped support frame could be made of wood using a concealed steel lamellar spring for the motion of the rear vertical articulated section of the frame.

In Brief

A self-reclining chair 20 having a variable geometry frame comprising a combination of:

1) a U-shaped support-frame, view from the chair profile, with horizontal member standing on the ground, the U-shaped support frame extending with sufficient breadth to provide chair transversal stability, the U-shaped support frame having a fixed front-leg with an articulated rear-leg fitted at lower end with spring hinge forcing angular displacement of the rear-leg to slant backward, to pull the chair in a reclined motion, both the fixed front-leg and articulated rear-leg being slightly slanted with upper ends of the front-leg extending towards front of the chair, and of the articulated rear-leg extending right over the haunch level of the chair, when the chair is settled to non-reclined seating position,
2) an aggregate arched-shaped seat panel comprises a seat portion panel having a hinged back rest panel, the aggregate seat portion panel and the back-rest panel being linked directly over upper ends of the front and rear legs of the U-shaped support frame, the hinge being located between both the front and rear legs of the support frame to provide a lever for the angular displacement of the back-rest, front end of the arched-shaped seat panel having clamp for angular displacement about transversal axis locate at upper ends of the front-leg, and the back-rest having clamp for angular displacement about rear transversal axis locate at upper ends of the rear-leg of the U-shaped support frame,
3) a tension-mechanism linked to the support frame and having incremental adjustment, the tension mechanism rigged to pull down the seat portion panel, and to modify span between the upper ends of both the legs of the U-shaped support-frame, and to induce angular displacement of the aggregate seat and the back-rest panel, the tension-mechanism being calibrated to overcome spring load of the articulated rear-leg of the U-shaped support frame,
4) A control stopper is integrated to the tension mechanism for automatic engagement in synchronisation, the stopper being settled to overcome pull load of the tension-mechanism, the stopper being fitted with several step-stops positions means to provide incremental adjustment of chair reclined configurations.

The self-reclining chair has an arched-shaped seat panel with an aggregate leg-rest hinged in its front end, the aggregate leg-rest, seat and back-rest panels being linked directly over both upper ends of the front and rear legs of the U-shaped support frame, the leg-rest having clamp for angular displacement about transversal axis located at upper end of the front-leg hinge of the leg-rest being located between both the front and rear-legs, to provide levers for angular displacement of the leg-rest.

The self-reclining chair having a reclined seat configuration regulated by the angular displacement of the articulated rear-leg of the U-shaped support-frame, causing variation of the span between suspension points of the aggregated seat portion panel to induce rotation for angular displacement of linked the back-rest, the arched-shaped seat panel, and the leg-rest.

The self-reclining chair wherein the tension mechanism comprising a winch shaft with crank handle, fitted under the seat portion panel, winding a strap rigged like a tackle between the seat portion panel and base of the U-shaped support frame, causing the tension mechanism to pull down the seat portion panel and induce rotation for angular displacement of the back-rest and leg-rest in a position limited by the arched-shaped seat panel clamping means.

The self-reclining chair wherein the seat fully reclined position is achieved by releasing the pull of the tension mechanism; the intermediated and non-reclined seating position being achieved and maintained by conjugated action of the tension mechanism and the stopper settled to overcome spring load of the articulated rear-leg of the U-shaped support frame.

The self-reclining chair wherein the U-shaped support frame is made with twin parallel mounted U-shaped members viewed from the chair profile, connected with transversals bars, each U-shaped members having a fixed front-leg and spring hinged rear-leg forcing angular displacement to slant backward the rear-leg to pull chair in a reclined motion, both the front-leg and rear-leg being slightly slanted with upper ends extending towards front of the chair, when the tension mechanism is settled to hold the chair in the non-reclined seating position.

The self-reclining chair wherein the U-shaped support-frame, the seat and the back-rest panels are moulded with resilient material for integration of live hinges on transversal articulations axis of the chair the variable geometry frame.

The self-reclining chair wherein the tension mechanism and the integrated stopper include an electric winch winding a strap rigged to pull between the seat portion panel and base of the U-shaped support-frame, to induce angular displacement of linked the back-rest and the leg-rest. The self-reclining chair wherein the horizontal member of the U-shaped support frame is made with resilient material to be bent under full load of the tension mechanism, and to provide possible rocking motion when the chair is in a non-reclined seating position.

The scope of this patent application is also to cover other embodiments fitted with features that are not essential parts of the described invention and for this reason are not required to be covered by the claims for a self-reclining chair. It is to be clearly understood that the instant description with reference to the annexed drawing is made in an indicative manner and that the preferred embodiments described herein are meant in no way to limit further embodiments realizable within the scope of the invention. The matter which is claimed as being inventive and new is limited only by the following claims.

DRAWING REFERENCE NUMERALS

20 Reclining chair
21 Flexible arched-shaped seat panel
22 Back-rest panel
22' Seat portion panel
24,25 Flexible U-shaped supports frames
25',25" Aft and forward ends of the U-shaped support frame 25
26,26' Rear legs of the U-shaped support frame 24
27,27' Front lees of the U-shaped support frame 24
28 Tension mechanism
30 Cut-out opening in flexible arched-shaped seat panel
32 Crank handle
34 Stopper adjustment knobs
36 Leg-rest panel
38 Leg-rest panel hinges
40,41 Seat panel articulated clamps
42,44 Front upper and lower transverse bars
46 Rear transverse bar
48 Cut-out opening in the flexible U-shaped support frame
48' Reduced geometrical section of the material of the chair
50 Shaft of winch tension mechanism
52,52' Shaft pillow blocks
54 Leg-rest panel articulated clamp
56 Tension tackle strap
58 Stopper sliding pins

60 Stopper spring bolt
62 Stopper holding balls
64 Shaft ring stopper
66 Spring part hinge joint of the seat panel
68 Spring part hinge joint of the support panel
70 Rope ending with means of grip
72,72' Horizontal members

I claim:

1. A self-reclining chair having a variable geometry frame comprising a combination of:

a. a U-shaped support-frame with a horizontal member extending along a support surface, said U-shaped support frame providing said chair with transversal stability, said U-shaped support frame having a fixed front-leg (25') with an articulated rear-leg (25") fitted at lower end with a spring hinge (68) forcing angular displacement of said rear-leg to slant backwards, to pull said chair in a reclined motion, both said fixed front-leg and articulated rear-leg being slightly slanted in a forward direction with an upper end of said front-leg extending toward the front of said chair, and said articulated rear-leg extending over a haunch level of said chair, when said chair is in a non-reclined seating position, b. an arched-shaped seat panel comprising a seat portion panel having a hinged back-rest panel, said seat portion panel and said back-rest panel being linked to said upper ends of said front and rear legs, respectively, of said U-shaped support frame, said hinge being located between both said front and rear legs of said U-shaped support frame to provide a lever for said angular displacement of said back-rest panel, a front end of said seat panel having a clamp for angular displacement about a transversal axis located at an upper end of said front-leg, and said back-rest panel having a clamp for angular displacement about a rear transversal axis located at the upper end of said rear-leg of said U-shaped support frame, c. a tension-mechanism linked to said support frame and having incremental adjustment, said tension mechanism configured to pull said seat portion panel downwardly, and to modify the span between said upper ends of said front and rear legs of said U-shaped support frame, and to angularly displace seat panel and said back-rest panel, said tension-mechanism configured to overcome a spring load of said articulated rear-leg of said U-shaped support frame, and d. a control stopper connected to said tension mechanism for automatic synchronized engagement, said control stopper configured to overcome the downward pull of said tension-mechanism, said control stopper being including means to provide incremental adjustments of reclined positions of said chair.

2. The self-reclining chair of claim 1, wherein said seat panel has a leg-rest hinged to its front end, said leg-rest and said seat and back-rest panels being linked directly to said upper ends of said front and rear legs of said U-shaped support frame, said leg-rest having clamp for angular displacement about a transversal axis located at the upper end of said front-leg and the hinge at the upper end of the front leg to provide a lever for angular displacement of said leg-rest.

3. The self-reclining chair of claim 2, wherein a reclined seat configuration is regulated by said angular displacement of said articulated rear-leg of said U-shaped support-frame, causing variations of said span between suspension points of said seat portion panel to allow rotation for angular displacement of said back-rest, said seat portion panel, and said leg-rest.

4. The self-reclining chair of claim 3, wherein said tension mechanism and said control stopper include an electric winch winding a strap configured to pull between said seat portion panel and base of said U-shaped support-frame, to provide angular displacement of said back-rest and said leg-rest.

5. The self-reclining chair of claim 3, wherein said horizontal member of said U-shaped support frame is made from resilient material to allow bending under full load of said tension mechanism, and to provide rocking motion when said chair is in a non-reclined seating position.

6. The self-reclining chair of claim 3, wherein said tension mechanism comprises a winch shaft with a crank handle fitted under said seat portion panel, a strap wound between said seat portion panel and base of said U-shaped support frame, causing said tension mechanism to pull downwardly on said seat portion panel and allow angular rotation of said back-rest and leg-rest in a position limited by said seat panel clamp.

7. The self-reclining chair of claim 3, wherein a fully reclined seat is achieved by releasing said pull of said tension mechanism; intermediate and non-reclined seating positions being achieved and maintained by conjugated action of said tension mechanism and said stopper overcomes the spring load of said articulated rear-leg of said U-shaped support frame.

8. The self-reclining chair of claim 3, wherein said U-shaped support frame is made with twin parallel mounted U-shaped members connected with transversals bars, each U-shaped member having a fixed front-leg and spring hinged rear-leg forcing angular displacement to backwardly slant said rear-leg to pull the chair in a reclined motion, both said front-leg and rear-leg being slightly slanted with upper ends extending towards the front of said chair, said tension mechanism holding said chair in the non-reclined seating position.

9. The self-reclining chair of claim 2, wherein said U-shaped support-frame, said seat and said back-rest panels are moulded from a resilient material for integration of live hinges on transversal articulation axes of said chair.

* * * * *